US008306443B2

(12) United States Patent
DiRubio et al.

(10) Patent No.: US 8,306,443 B2
(45) Date of Patent: Nov. 6, 2012

(54) MULTI-COLOR PRINTING SYSTEM AND METHOD FOR REDUCING THE TRANSFER FIELD THROUGH CLOSED-LOOP CONTROLS

(75) Inventors: Christopher A. DiRubio, Webster, NY (US); Aaron Michael Burry, Ontario, NY (US); Antonio DeCrescentis, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 468 days.

(21) Appl. No.: 12/581,281

(22) Filed: Oct. 19, 2009

(65) Prior Publication Data

US 2010/0329702 A1 Dec. 30, 2010

Related U.S. Application Data

(60) Provisional application No. 61/220,780, filed on Jun. 26, 2009.

(51) Int. Cl.
*G03G 15/00* (2006.01)
*G03G 15/16* (2006.01)

(52) U.S. Cl. ..... 399/49; 399/66

(58) Field of Classification Search ..... 399/46, 399/49, 53, 66
See application file for complete search history.

(56) References Cited

U.S. PATENT DOCUMENTS

| | | | | |
|---|---|---|---|---|
| 5,978,615 | A * | 11/1999 | Tanaka et al. | 399/49 |
| 6,611,665 | B2 | 8/2003 | DiRubio et al. | |
| 6,807,390 | B2 | 10/2004 | Suda et al. | |
| 6,917,770 | B2 | 7/2005 | Bae et al. | |
| 7,024,125 | B2 | 4/2006 | Ishi et al. | |
| 7,298,980 | B2 * | 11/2007 | Ramesh et al. | 399/27 |
| 2006/0165424 | A1 | 7/2006 | Tabb et al. | |
| 2006/0222381 | A1 | 10/2006 | Moriya et al. | |
| 2008/0152369 | A1 | 6/2008 | DiRubio et al. | |
| 2008/0152371 | A1 | 6/2008 | Burry et al. | |

FOREIGN PATENT DOCUMENTS

| | | | |
|---|---|---|---|
| DE | 3115351 | A1 | 4/1981 |
| JP | 356146156 | A1 | 11/1981 |
| JP | 2000194157 | A * | 7/2000 |
| JP | 2009015288 | A * | 1/2009 |

* cited by examiner

*Primary Examiner* — David Gray
*Assistant Examiner* — Erika J Villaluna
(74) *Attorney, Agent, or Firm* — Fay Sharpe LLP

(57) ABSTRACT

Multi-color document processing systems and methods are described in which the toner detachment field distribution curve is measured as a function of transfer field and the curve is shifted by adjustment of one or more toner state adjustment actuators to facilitate operation at lower transfer field levels for mitigating retransfer and other high field defects.

24 Claims, 9 Drawing Sheets

MULTI-COLOR PRINTING SYSTEM AND METHOD FOR REDUCING THE TRANSFER FIELD THROUGH CLOSED-LOOP CONTROLS

REFERENCE TO RELATED APPLICATION

This application claims priority to and the benefit of U.S. Provisional Patent Application Ser. No. 61/220,780, which was filed Jun. 26, 2009, entitled MULTI-COLOR PRINTING SYSTEM AND METHOD FOR REDUCING THE TRANSFER FIELD THROUGH CLOSED-LOOP CONTROLS, the entirety of which application is hereby incorporated by reference.

BACKGROUND

The disclosures of Published U.S. Patent Application Nos. 2008/0152369 to DiRubio et al. and 2008/0152371 to Burry et al. are hereby incorporated by reference in their entireties. The present exemplary embodiments relate to document processing systems such as printers, copiers, multi-function devices, etc., and operating methods for mitigating retransfer and other high field failure modes associated with air breakdown. Examples of these failure modes include, but are not limited to, image noise, image mottle, deletions, color shifts, poor color macro-uniformity, poor color stability, and cross color developer contamination. Multi-color toner-based Xerographic printing systems typically employ two or more xerographic marking devices to individually transfer toner of a given color to an intermediate transfer medium, such as a drum or belt, with the toner being subsequently transferred from the intermediate medium to a sheet or other final print medium, after which the twice transferred toner is fused to the final print. Retransfer occurs when toner on the intermediate belt from previous, upstream marking devices is wholly or partially removed (scavenged) due to high fields within the transfer nip. High fields in the transfer nips in the previous downstream marking devices can adversely modify the charge state of the toner on the intermediate transfer belt (ITB) through air breakdown mechanisms, further exacerbating retransfer. When this happens, the desired amount of one or more toner colors is not transferred to the final printed sheet, and the retransfer problem worsens as the number of colors increases. Retransfer at a given marking device may be reduced by lowering the transfer field strength at that device, but this may lead to incomplete transfer during image building at that device. In other words, the transfer nip may be transferring toner to the ITB at one region in the cross-process direction (image building), which requires high fields, while simultaneously scavenging toner from the ITB in another region (retransfer). In addition, the quality requirements of multi-color document processing systems are constantly increasing, with customers demanding the improved imaging capabilities without the adverse effects of retransfer and incomplete transfer. Accordingly, a need remains for improved multi-color document processing systems and operational techniques through which retransfer and the aforementioned problems can be mitigated.

BRIEF DESCRIPTION

The present disclosure provides document processing systems and methods that may be employed to control retransfer and incomplete transfer in systems having multiple marking devices by individually characterizing the toner state of one or more of the marking devices in an adjustment mode and selectively adjusting or changing one or more actuators to modify the toner state. The operating transfer field setpoints of one or more marking devices downstream of the adjustment mode actuation can then be lowered to mitigate or avoid retransfer and other high field failure issues while controlling incomplete transfer. The techniques of the present disclosure can be advantageously implemented to adjust the field control operating points of one or more marking devices to allow the devices to operate at or near the minimal transfer field strength that provides an acceptable level of incomplete transfer, where the lowered field levels reduce the likelihood or amount of retransfer and other defects normally associated with higher transfer fields.

In accordance with one or more aspects of the present disclosure, a method is provided for operating a document processing system having a plurality of marking devices (marking devices as used herein includes without limitation marking engines, marking stations, etc.). The method involves operating the marking devices in a normal mode to selectively transfer marking material onto the medium in accordance with a print job, and in an adjustment mode to allow reduction in the operating field levels of the marking devices. In the adjustment mode, the individual marking devices are operated to transfer marking material onto the medium at a first value of a transfer field control input and at least one value of an adjustment input controlling an operating parameter of a toner state adjustment actuator in the system (whether associated with a specific marking device or another actuator in the system). Marking material transfer condition values are obtained corresponding to the field control and toner state adjustment actuator input values from which a marking material transfer condition relationship is derived, such as a probability density function (PDF) or a cumulative density function (CDF) representing the toner state as a function of the transfer field. The method in the adjustment mode further includes selectively changing the adjustment input(s) based at least partially on the derived transfer condition relationship. The transfer condition relationship in one embodiment is a toner detachment field distribution curve as a function of the transfer field, which has a mean and a width, where the adjustment input or inputs are selectively changed so as to reduce the mean and/or width of the distribution curve.

The method further includes again transferring marking material onto the medium at the first value of the transfer field control input, obtaining adjusted marking material transfer condition values, and deriving an adjusted marking material transfer condition relationship as a function of the transfer field based on the adjusted marking material transfer condition values. The method further includes selectively changing (e.g., lowering) the transfer field control input for one or more individual marking devices, such as to a lowered transfer field value that provides acceptable transfer of marking material according to the adjusted marking material transfer condition relationship, and thereafter operating the marking device(s) in the normal mode at the new (e.g., lowered) transfer field value(s) to selectively transfer marking material onto the medium in accordance with a print job. In a related aspect, the transfer field generating components of all or at least some of the marking devices may remain powered while operating individual ones of the marking devices in the adjustment mode. In various embodiments, changing the adjustment input may include changing a toner dispense rate control input to adjust a charge to mass ratio of the toner in a mixture of toner and carrier in the marking device, changing a pre-transfer charging device adjustment control input to adjust toner charge state in the marking device, and/or changing a toner additive state adjustment control input to adjust a toner additive state in the marking device.

A document processing system is provided in accordance with other aspects of the disclosure. The system is comprised of a plurality of marking devices, such as xerographic marking devices in one embodiment (e.g., also referred to as xerographic marking engines or marking stations), which are operative to transfer toner or other marking material onto a corresponding medium, such as an intermediate transfer belt or drum. The individual marking devices include one or more transfer field control actuators having a transfer field control input for setting the transfer field used to transfer marking material onto the medium. The system further includes a sensor that measures or senses toner adhesion or other marking material transfer condition associated with the medium, and one or more toner state adjustment actuators are provided with adjustment inputs for adjusting an operating parameter associated with the transfer of marking material onto the medium. The toner state adjustment actuators may be associated with a specific marking device of the system or may be system actuators not associated with a marking device. The sensor in one embodiment is operative to sense residual mass per unit area (RMA) of marking material not transferred to the medium. In various embodiments, moreover, the adjustment inputs may include a toner dispense rate control input to adjust a charge to mass ratio of the toner in a mixture of toner and carrier, a pre-transfer charging device adjustment control input to adjust toner charge state, and/or a toner additive state adjustment control input to adjust a toner additive state.

The document processing system also includes a controller that operates in a normal mode to selectively cause one or more of the marking devices to transfer marking material onto the medium according to a print job. The controller is also operative in an adjustment mode to cause individual marking devices to transfer marking material onto the medium at a first value of the transfer field control input and at least one value of the adjustment input(s). The controller obtains marking material transfer condition values from the sensor corresponding to the transfer field control and adjustment input values, and derives a marking material transfer condition relationship as a function of the transfer field based on the marking material transfer condition values from the sensor. The derived relationship in certain implementations can be a probability density function (PDF) or a cumulative density function (CDF) representing the toner state as a function of the transfer field. The controller is operative to selectively change one or more adjustment inputs based at least partially on the derived transfer condition relationship. Following the adjustment, the controller causes the operated marking device to again transfer marking material onto the medium at the first transfer field value, obtains adjusted transfer condition values from the sensor, and derives an adjusted transfer condition relationship as a function of transfer field based on the adjusted sensor values. The controller then selectively changes the transfer field control input based at least partially on the adjusted marking material transfer condition relationship, and the controller thereafter operates in the normal mode to selectively cause one or more of the marking devices to transfer marking material onto the medium in accordance with a print job using the changed transfer field control input value. In further aspects of the disclosure, the controller selectively lowers the transfer field control input to a value that provides acceptable transfer of marking material according to the adjusted marking material transfer condition relationship. In one embodiment, the relationship is a toner detachment field distribution curve as a function of the transfer field that has a mean and a width, where the controller selectively changes the adjustment input(s) so as to reduce one or both of the mean and the width of the distribution curve to facilitate lowering of the operating field strength in the normal printing mode. In this manner, one or more of the device transfer field levels may be reduced to combat retransfer and other high field defects without significantly increasing incomplete transfer problems.

BRIEF DESCRIPTION OF THE DRAWINGS

The present subject matter may take form in various components and arrangements of components, and in various steps and arrangements of steps. The drawings are only for purposes of illustrating preferred embodiments and are not to be construed as limiting the subject matter.

DETAILED DESCRIPTION

Figure 1:
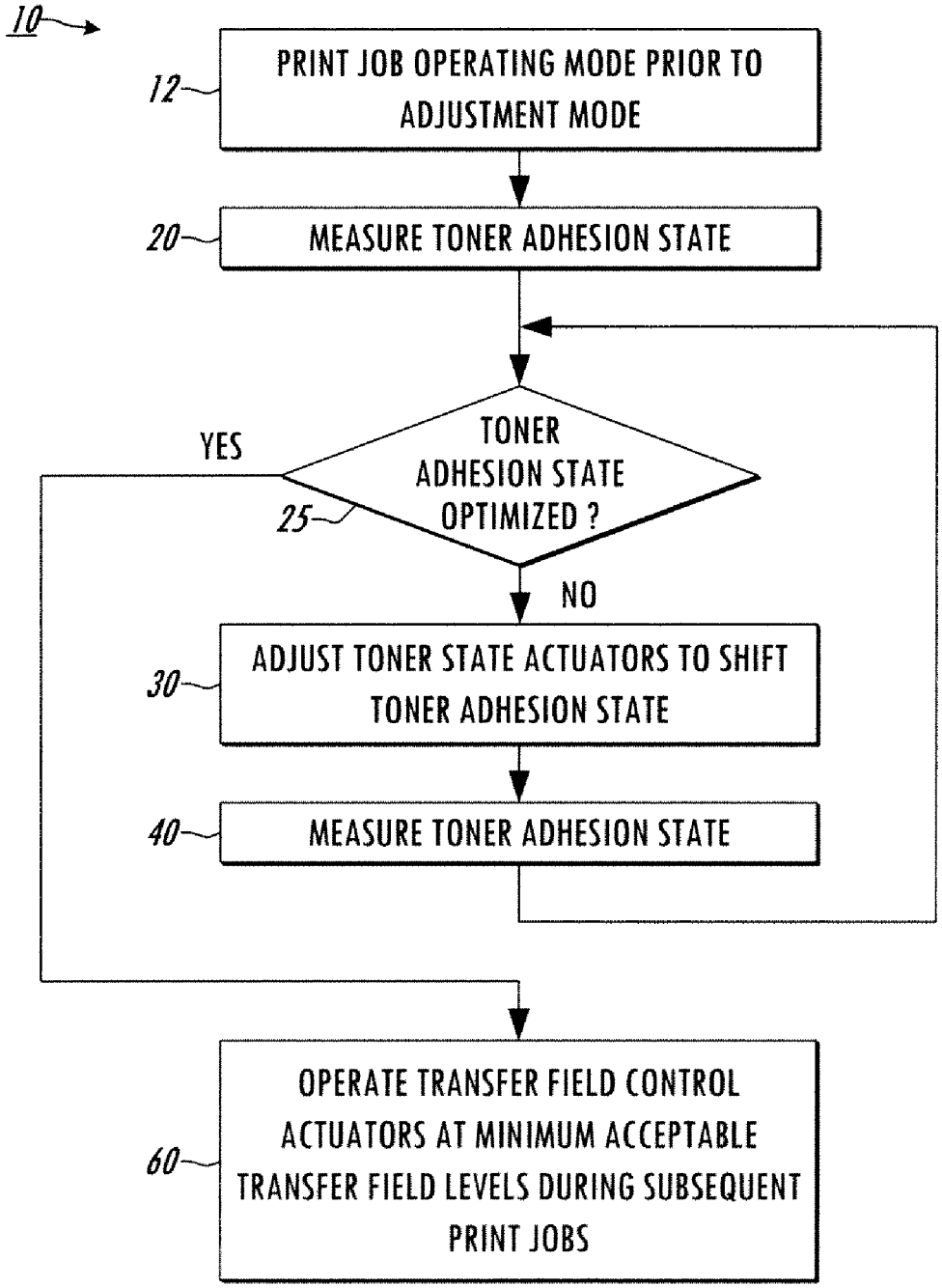
FIG. 1 is a flow diagram illustrating an exemplary method for operating a document processing system in accordance with one or more aspects of the disclosure.

Several embodiments or implementations of the different aspects of the present disclosure are hereinafter described in conjunction with the drawings, wherein like reference numerals are used to refer to like elements throughout, and wherein the various features, structures, and graphical renderings are not necessarily drawn to scale. The disclosure relates to use of toner state measurements and selective adjustment of print engine operating parameters to lower toner adhesion state, thereby allowing lower transfer field level operation to combat incomplete transfer, retransfer, and other defects or adverse print engine performance issues related to transfer field operational levels. Certain exemplary embodiments are illustrated and described below in the context of exemplary multi-color document processing systems that employ multiple xerographic marking devices or stations, including tandem and/or image-on-image (IOI) systems, in which toner marking material is first transferred to an intermediate medium and ultimately transferred to a final print medium to create images thereon in accordance with a print job. However, the techniques and systems of the present disclosure may be implemented in other forms of document processing or printing systems that employ any form of marking materials and techniques in which marking device fields are used for material transfer, such as ink-based printers, etc., wherein any such implementations and variations thereof are contemplated as falling within the scope of the present disclosure.

Figure 2:
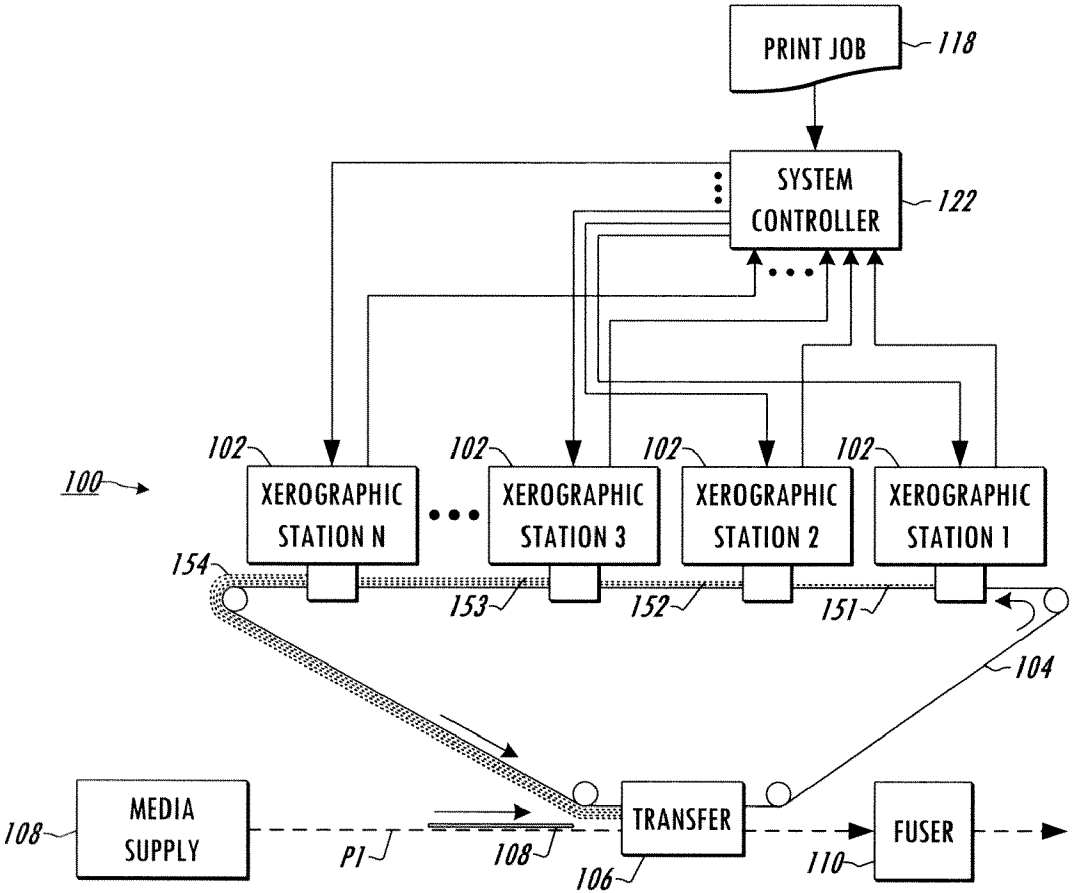
FIG. 2 is a simplified schematic system level diagram illustrating an exemplary multi-color document processing system with multiple xerographic marking devices disposed along a shared intermediate transfer belt (ITB) with a controller configured to measure and adjust the toner transfer state of the individual marking devices for operating at lower field levels in accordance with several aspects of the disclosure.

An exemplary printing method 10 is illustrated in FIG. 1, and FIG. 2 illustrates an exemplary tandem multi-color document processing system 100, where the system 100 and a system controller 122 and marking devices 102 thereof may be operated in accordance with the method 10 in a normal printing mode and in an adjustment mode according to various aspects of the present disclosure. The system 100 of FIG. 2 includes a plurality of xerographic marking devices 102 individually operative to transfer toner marking material onto an intermediate substrate 104 that may or may not be a photoreceptor, in this case, a shared intermediate transfer belt (ITB) 104 traveling in a counter clockwise direction in the figure past the xerographic marking devices 102, also referred to as marking engines, marking elements, marking stations, etc. In other embodiments, a cylindrical drum may be employed as an intermediate transfer substrate, with the marking devices 102 positioned around the periphery of the drum to selectively transfer marking material thereto.

Figure 3:
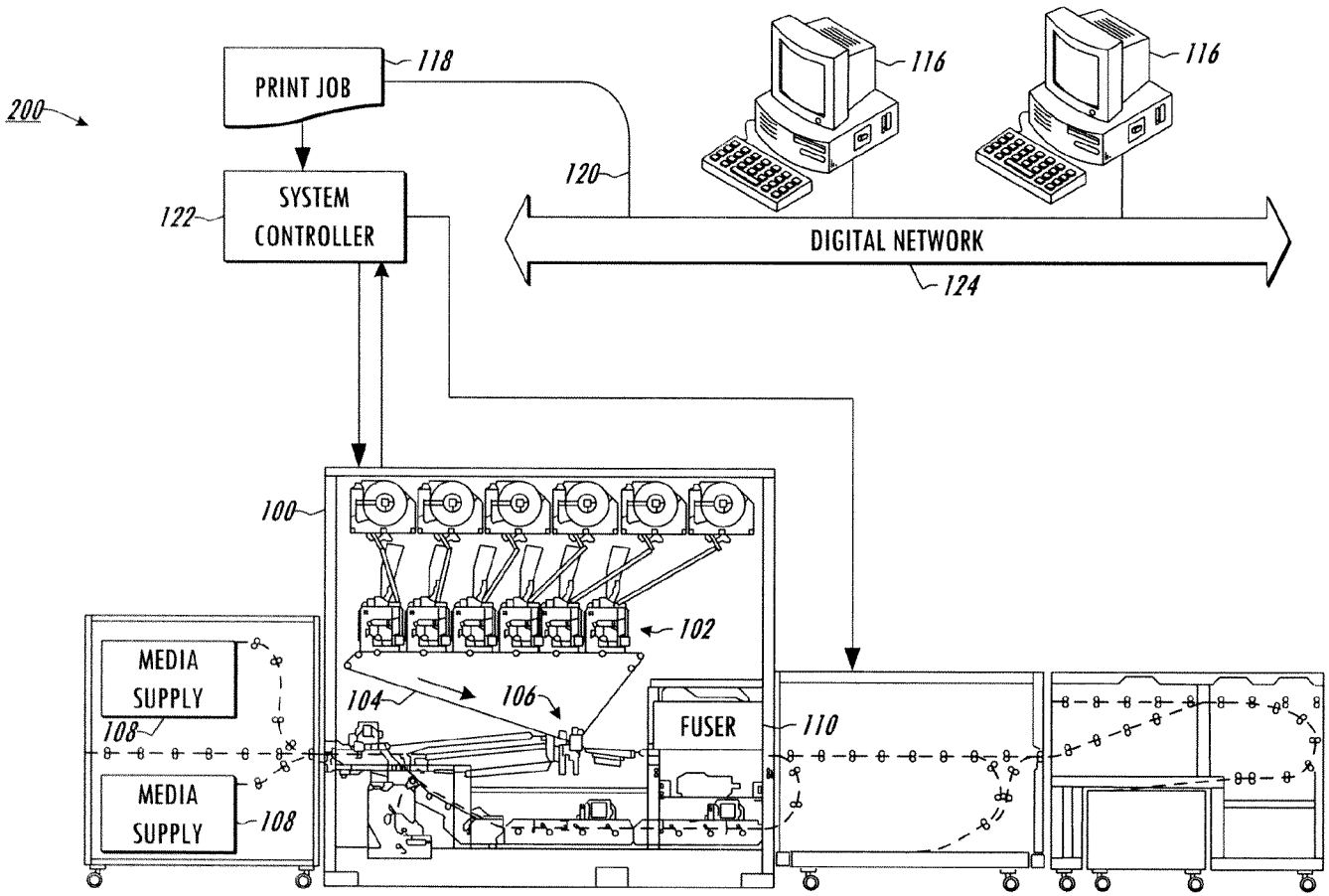
FIG. 3 is a detailed side elevation view illustrating an exemplary embodiment of the system of FIG. 2 in accordance with the present disclosure.
Figure 4:
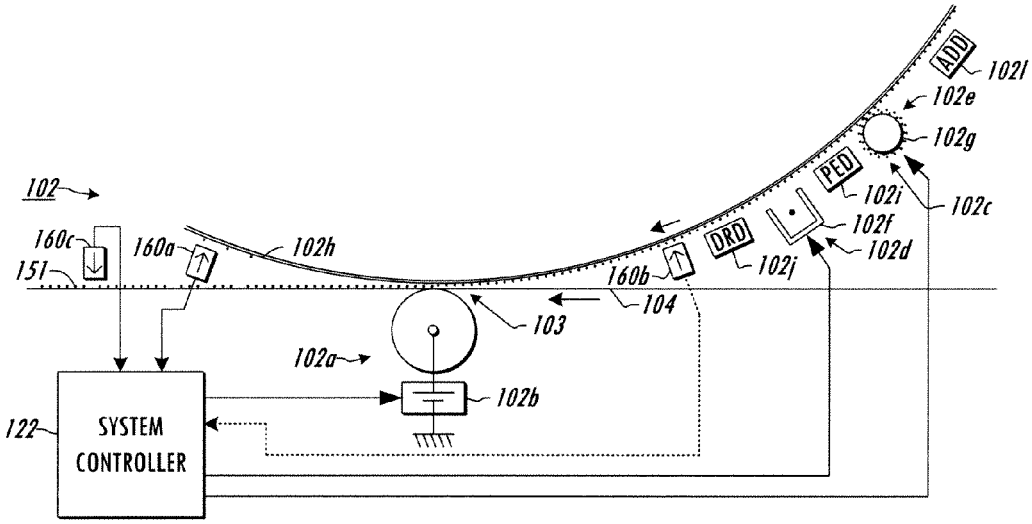
FIG. 4 is a schematic diagram illustrating further details of one of the marking devices in the system of FIGS. 1 and 2.

Referring also to FIG. 4, each exemplary xerographic marking device 102 includes a photoreceptor drum 102*h*, a pre-transfer charging subsystem 102*f*, a development subsystem 102*g*, a pre-transfer erase subsystem 102*i*, a pre-transfer debris removal subsystem 102*j*, a charging subsystem (e.g., charging system 210 in FIG. 8 below), an expose subsystem (e.g., expose system 220 in FIG. 8 below), and a cleaning subsystem (e.g., systems 260, 270 in FIG. 8 below), by which the toner image of a given color (e.g., cyan, magenta, yellow, black, or one or more spot toners or gamut extension colors such as orange or violet) is developed on a photoreceptor and transferred electrostatically to the intermediate transfer medium 104 using a biased transfer roller (BTR) 102*a* located on the inside of the intermediate transfer belt 104. The BTR 102*a* operates at a transfer field value set by a field strength control 102*b* to control the transfer field used by the device 102 to transfer marking material, in this case, toner, to the medium 102. The pre-transfer erase device (PED) 102*i* is a pre-transfer expose device to at least partially discharge the photoreceptor 102*h*, the ADD component 102*l* represents an additive dispense device to the photoreceptor to reduce toner adhesion, and the DRD component 102*j* of FIG. 4 represents a debris removal device to remove carrier beads or other large contaminants from the photoreceptor prior to transfer. Any integer number N marking devices 102 may be included in the system 100 of FIG. 1, where N is greater than or equal to two. In one exemplary implementation, the system 100 may include six such marking devices 102, as illustrated and described further below in connection with FIG. 3. The system 100 provides a plurality of toner state adjustment actuators with corresponding adjustment inputs for individually adjusting an operating parameter associated with transfer of marking material onto the medium 104, wherein the marking devices 102 individually include at least one of the toner state adjustment actuators, and wherein one or more of the toner state adjustment actuators are not associated with a specific one of the marking devices 102. It is noted that in the system 400 of FIG. 9 below, it is possible that none of the toner state adjustment actuators is within a xerographic marking device, and that the system could actuate only the pre-transfer device 102*d*, for example, which is external to all of the marking devices. Moreover, each of the exemplary marking devices 102 includes one or more transfer field control actuators that control a transfer field used to transfer marking material to the medium 104, with the individual transfer field control actuators having a corresponding transfer field control input.

The system 100 also includes a transfer component 106 (FIG. 2) disposed downstream of the marking devices 102 along a lower portion of the ITB path to transfer marking material from the ITB 104 to an upper side of a final print medium 108 (e.g., precut paper sheets in one embodiment) traveling along a path P1 from a media supply. After the transfer of toner to the print medium 108 at the transfer station 106 in FIG. 2, the final print medium 108 is provided to a fuser type affixing apparatus 110 on the path P1 where the transferred marking material is fused to the print medium 108.

The document processing system 100 includes a controller 122 that performs various control functions and may implement digital front end (DFE) functionality for the system 100, where the controller 122 may be any suitable form of hardware, software, firmware, programmable logic, or combinations thereof, whether unitary or implemented in distributed fashion in a plurality of components, wherein all such implementations are contemplated as falling within the scope of the present disclosure and the appended claims. In a normal printing mode, the controller 122 receives incoming print jobs 118 and operates the marking devices 102 to transfer marking material onto the intermediate medium 104 in accordance with the print job 118.

In the exemplary system 100, moreover, the controller 122 operates in an adjustment mode to adjust one or more actuators of one or more of the marking devices 102 and/or of the system 100 generally, to adjust the toner transfer and/or adhesion state, and to then adjust the operating transfer field 102*b* of one or more of the marking devices 102 to mitigate retransfer effects and other high transfer field defects in normal printing operation of the system 100. In this regard, the system 100 employs toner state sensing as feedback to the controller 122 for selective adjustment of various toner state adjustment actuators, including without limitation the development system 102*g* and/or the pre-transfer charging system 102*d*, and/or the expose system (220 in FIG. 8 below) in order to adjust or shift the toner transfer or adhesion relationship with respect to transfer field strength of the transfer field control actuator components (e.g., BTR 102*a* and field strength control 102*b*).

Figure 7:
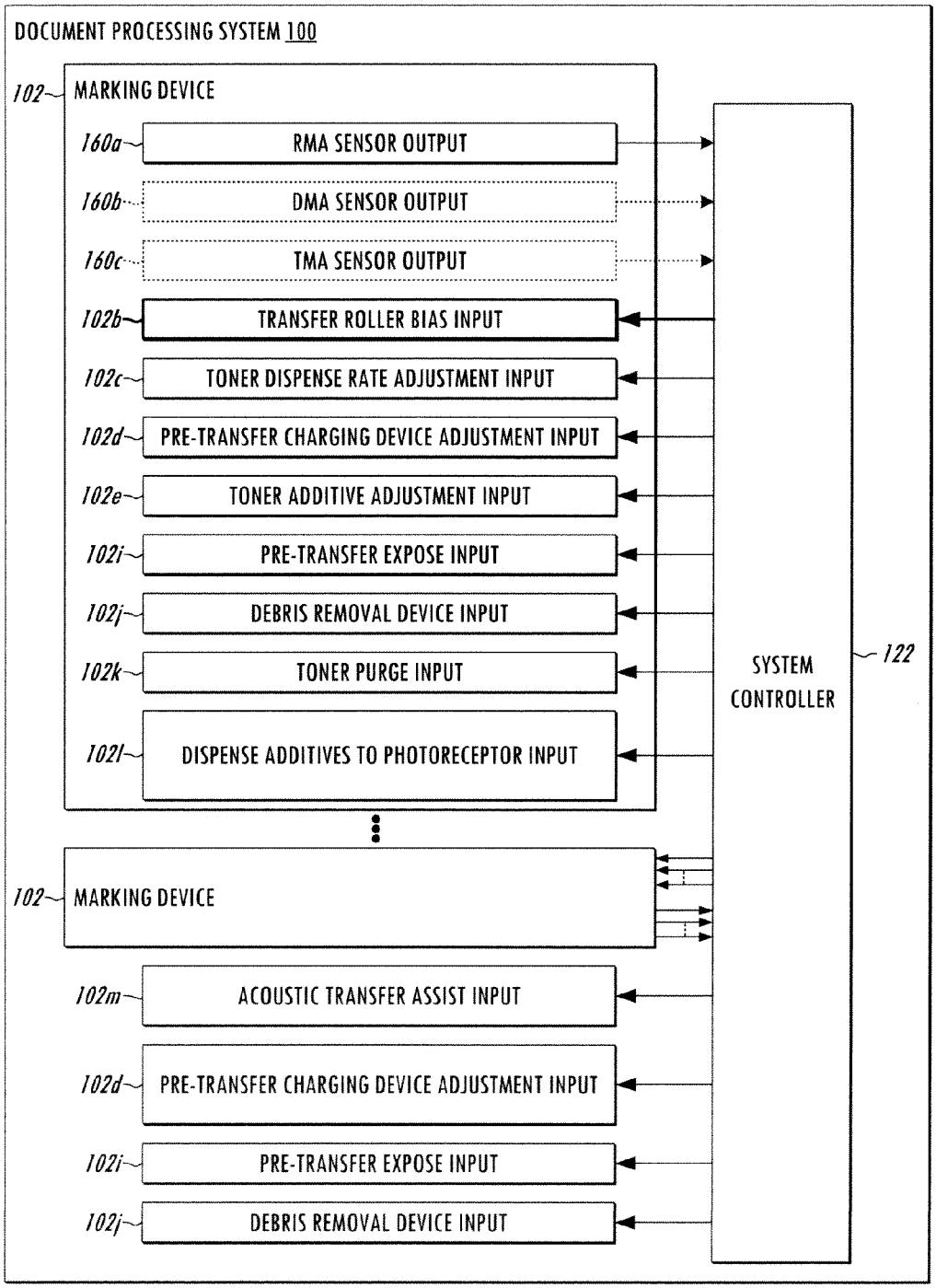
FIG. 7 is a schematic diagram illustrating various adjustment inputs and sensor outputs of an exemplary xerographic marking device and connections thereof to the controller in the system of FIGS. 1 and 2.

In operation, the controller 122 generates signals or values provided as inputs to the various transfer field control components and toner state adjustment actuators of the system 100. As shown in FIG. 7 below, examples of transfer field control inputs include inputs associated with the BTR 102*a* and field strength control 102*b* in FIG. 4 (e.g., transfer roller bias input 102*b*) associated with the marking devices 102, as well as any other input provided for controlling or modifying an electric or magnetic field used in transferring marking material to a medium in a document processing system. A non-exhaustive list of adjustment inputs includes marking material (e.g., toner) dispense rate adjustment inputs (e.g., 102*c*), pre-transfer charging device adjustment inputs (e.g., 102*d*, whether associated with a specific marking device 102 or not), toner additive adjustment inputs (e.g., 102*e*), pre-transfer expose adjustment inputs and/or debris removal device inputs (e.g., 102*i* and/or 102*j*, for actuators specific to a marking device 102 and/or general system actuators), toner purge inputs (e.g., 102*k*), inputs controlling dispensing of additives to a photoreceptor (e.g., 102*l*), one or more acoustic transfer assist inputs (e.g., 102*m*), and/or any other input provided by the controller 122 to a system actuator that affects a marking material transfer condition of the medium 104 to which the marking material is transferred by one or more marking devices 102.

The inventors have appreciated that shifting the toner transfer curves, as illustrated and described further below with respect to FIGS. 5 and 6, facilitates operation in the normal mode at lower transfer field levels in one or more of the marking devices 102. In particular examples discussed further below, one marking device 102 at a time is operated at a first transfer field value (e.g., different control input value at the control 102*b* of the BTR 102*a* in FIG. 4), with or without the other marking devices 102 of the system 100 powered to provide their own (e.g., static) transfer fields along the ITB 104, and with various actuators operated at one or more adjustment input values in order to alter and then measure the toner detachment probability distribution and/or cumulative distribution function as a function of transfer field. This describes the toner state measurement step of FIG. 1 (steps 20 and 40). In step 20, the toner state actuators may be either (1) off or (2) on at their normal print job value. In step 40 the toner state actuators may be (1) off, (2) on at their normal print job level, or (3) on at the adjustment value from step 30. Moreover, while measuring the toner state at just one transfer field value may be adequate, other embodiments are possible in which the toner state is measured at two or more transfer field values. In preferred implementations, at least one of the toner state adjustment actuators being provided with inputs is upstream of (e.g., prior to) a transfer nip associated with the transfer field control actuator whose transfer field input is being reduced. Moreover, depending on the architecture of a given system 100, the material state actuation may occur entirely outside of the xerographic station 102 through toner state adjustment actuators not associated with a specific marking device 102, for example, in image-on-image type systems 400 shown in FIGS. 9 and 10. Also, for the exemplary tandem architecture in FIGS. 2-4 and 8, the controller 122 can actuate one or more toner state adjustment actuators associated with the secondary transfer device 106 that transfers marking material from the medium 104 to a final printed medium 108 with a pre-transfer device pointing at the ITB 104 (e.g., similar to 102*f* in FIGS. 9 and 10) that is outside of all the marking stations 102. In one embodiment, adjustment of various toner state adjustment actuators (e.g., development sub-system 102*g*, pre-transfer charging system 102*d*, etc. in FIGS. 2-4 and 8), the width and mean of the detachment distribution can be minimized in order to operate transfer at the lowest possible field strength. By lowering the transfer field, retransfer (and other high field failure modes) can be minimized in order to avoid color shifts, poor color macro-uniformity, poor color stability, cross color developer contamination, etc.

As shown in the embodiment of FIG. 4, the exemplary marking devices 102 include one or more sensors 160 providing input signals or values to the controller 122, such as an optical (e.g. reflective) sensor 160*a* downstream of the BTR 102*a* for sensing the residual mass per unit area (RMA) of marking material (e.g., toner) 151 not transferred from the drum 102*h* to the ITB 104, and an optional sensor 160*b* upstream of the BTR 102*a* for sensing the developed toner mass per unit area (DMA) or an optional sensor (e.g. an optical reflectance sensor) 160*c* downstream of the BTR 102*a* for sensing the transferred mass per unit area on the ITB 104. Moreover, one or more sensors 160 may be provided for measuring a marking material transfer condition of the medium 104 separate from any of the marking devices 102. Any type of sensor or sensors 160 may be employed which measure or sense toner state characteristics from which the toner transfer state of the marking device 102 can be derived. Suitable types of sensors 160*a*, 160*b*, and 160*c* are described in DiRubio et al., U.S. Pat. No. 7,190,913, filed Mar. 31, 2005, owned by the assignee of the present disclosure, the entirety of which patent is hereby incorporated by reference in its entirety as if fully set forth herein.

In operation of the marking devices 102, marking material (e.g., toner 151 for the first device 102 in FIG. 4) is supplied to the drum 102*h*. A surface of the intermediate medium 104 is adjacent to and/or in contact with the drum 102*h* and the toner 151 is transferred to the medium 104 with the assistance of the biased transfer roller 102*a*, where the BTR 102*a* induces charge into the BTR and ITB surfaces 104 to attract oppositely charged toner 151 from the drum 102*h* to the ITB surface as the ITB 104 passes through a nip 103 created between the drum 102*h* and the charged transfer roller 102*a*, where the transfer charging is controlled by a bias control 102*b* operated by the system controller 122. The toner 151 ideally remains on the surface of the ITB 104 after it passes through the nip 103 for subsequent transfer and fusing to the final print media 108 via the secondary transfer device 106 and fuser 110 in FIGS. 2 and 3.

The marking device 102 may suffer from incomplete transfer in which case a small amount of toner 151 remains on the drum 102*h* downstream of the BTR 102*a*, particularly for low transfer field levels. The exemplary sensor 106*a* is operatively coupled with the controller 122 and located proximate the downstream side of the drum 102*h* to detect the amount of untransferred toner 151 remaining on the drum 102*h*, where the illustrated example provides the sensor 160*a* as a residual mass per unit area (RMA) sensor that measures or senses the mass of residual toner 151 per a given area on the drum surface remaining after the drum 102*h* passes the nip 103. The device 102 (or the system 100 generally) can optionally include additional sensors, such as a transferred mass/area (TMA) sensor 160*c* for sensing the amount of toner 151 that is transferred to the intermediate medium 104, and a developed mass/area (DMA) sensor 160*b* that detects the amount of toner 151 supplied on the drum 102*h* upstream of the nip 103.

As best shown in FIG. 2, each of the xerographic marking devices 102 is operable under control of the controller 122 to transfer toner 151-154 of a corresponding color (e.g., cyan (C), magenta (M), yellow (Y), black (K)) to the transfer belt 104, where the first device 102 encountered by the ITB 104 in one example provides yellow toner 151, the next device provides magenta toner 152, the next provides cyan toner 153, and the last device 102 provides black toner 154, although other organizations and configurations are possible in which two or more marking devices 102 are provided.

FIG. 3 depicts a system 100 having six marking devices 102 configured along a shared or common intermediate transfer belt 104. FIG. 3 shows an exemplary system 200 including an embodiment of the above-described document processing system 100 having six marking stations 102 along with a transfer station 106, a supply of final print media 108, and a fuser 110 as described in FIG. 2 above. In normal operation, print jobs 118 are received at the controller 122 via an internal source such as a scanner (not shown) and/or from an external source, such as one or more computers 116 connected to the system 100 via one or more networks 124 and associated cabling 120, or from wireless sources. The print job execution may include printing selected text, line graphics, images, magnetic ink character recognition (MICR) notation, etc., on the front and/or back sides or pages of one or more sheets of paper or other printable media. In this regard, some sheets may be left completely blank in accordance with a particular print job 118, and some sheets may have mixed color and black-and-white printing. Execution of the print job 118, moreover, may include collating the finished sheets in a certain order, along with specified folding, stapling, punching holes into, or otherwise physically manipulating or binding the sheets. In certain embodiments the system 200 may be a stand-alone printer or a cluster of networked or otherwise logically interconnected printers, with each printer having its own associated print media source and finishing components including a plurality of final media destinations, print consumable supply systems and other suitable components. Alternately the system may be comprised of multiple marking engines 102 with a common media supply 108 and common finishers that are configured either serially or in parallel (separate parallel paper paths between feeding and finishing). The parallel configuration has the advantage that if one or more of the marking engines is inoperable, printing can continue on the remaining operable marking engines.

As best illustrated in FIGS. 2, 4, and 7, the individual marking devices 102 include a transfer field control input 102*b* for setting the transfer field level used to transfer marking material 151, 152, 153, 154 onto the intermediate substrate 104, as well as one or more sensors 160 operative to sense a marking material transfer condition such as RMA, TMA, DMA, etc., associated with the marking device 102 and one or more adjustment inputs 102*c*, 102*d*, 102*e*, 102*g*, 102*i*, 102*j*, 102*l*, and 102*m* of the system 100 generally or of the marking devices 102 are selectively actuated by the controller 122 in an adjustment mode for adjusting an operating parameter associated with the transfer of marking material 151, 152, 153, 154 onto the medium 104. In the example of FIGS. 4 and 7, the device-specific adjustment inputs that can be changed by the controller 122 include a toner dispense rate control input 102*c* to adjust a charge to mass ratio of a mixture of toner and carrier in the marking device 102, a pre-transfer charging device adjustment control input 102*d* to adjust toner charge state in the marking device 102, a pre-transfer erase device control input 102*i* to adjust the photoreceptor transfer field in the nip region 103 of the marking device 102, a pre-transfer debris removal device adjustment control input 102*j* to remove large particles prior to the transfer nip region 103, and/or a toner additive state adjustment control input 102*e* to adjust a toner additive state in the marking device 102. In addition to using the toner dispense control to vary the toner charge to mass ratio, toner purge stripes can be employed using the expose and the development subsystem 102*g*. The expose system is used in conjunction with the development sub-system 102*g* to generate toner purge stripes in the cross process direction in the inter-document zone between printing panels associated with adjacent pages. The purge stripes are transferred to the medium 104 and eventually cleaned by the cleaner on the medium. These stripes are not transferred to the paper 108 since they are printed in the inter-document zone. The marking devices 102 may also provide a toner purge control input 102*k* (FIG. 7) to adjust toner age and/or concentration of the marking device 102 by purging toner to reduce the toner concentration (ratio of toner to carrier) in the development sump, which increases the toner charge. In an alternate embodiment, the toner purge stripes may be developed during dedicated cycles, known as skipped pitches, wherein the printing of customer images has been temporarily suspended. The toner purge reduces toner age by developing aged toner from the development sump to the photoreceptor while dispensing fresh toner into the development sump. Compaction of surface spacer additives in aged toners can increase toner adhesion and adversely impact the toner adhesion state.

In accordance with the present disclosure, the controller 122 operates in a normal mode to selectively cause one or more of the marking devices 102 to transfer toner 151-154 onto the ITB 104 in accordance with a print job 118. In an adjustment mode, the controller 122 operates one or more individual marking devices 102, preferably while keeping transfer field generating components 102*a* of the other marking devices 102 powered at their normal levels with the operated marking device 102 transferring toner onto the medium 104 at a first transfer field level (e.g., one or more values of the transfer field control input 102*b* in FIGS. 4 and 7) and in some cases with one toner state adjustment actuator running while reading marking material transfer condition values (sensor inputs) from the sensor(s) 160. Depending on the location of the toner state sensor, there may be situations in which it is desirable to power 102*a* of the other devices at a lower level than normal.

Figure 5:
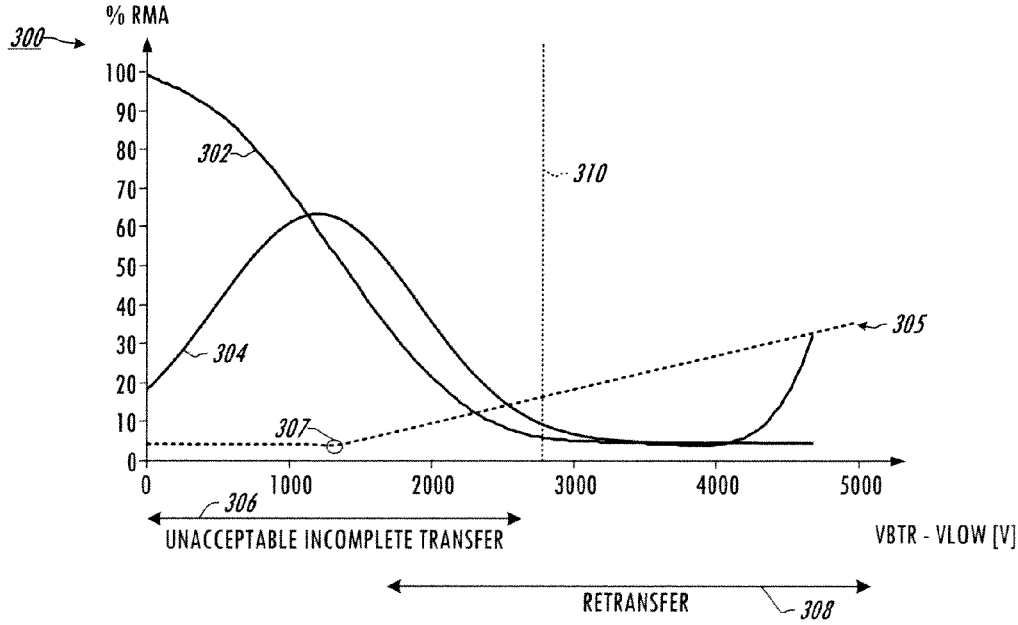
FIG. 5 is a graph illustrating two exemplary toner transfer condition relationships including a toner detachment probability density function (PDF) curve and a toner detachment cumulative density function (CDF) curve derived for one of the marking devices in the system of FIGS. 1 and 2.

Referring also to FIG. 5, the controller 122 is further operative to compute or otherwise derive or determine a marking material transfer condition relationship 302, 304 as a function of the transfer field, based wholly or partially on the marking material transfer condition values from the sensor(s) 160. FIG. 5 illustrates two examples, including a toner detachment probability density function (PDF) curve 304 having a width (e.g., standard deviation or multiple thereof) and a mean, as well as a toner detachment cumulative density function (CDF) curve 302, where the curves 302, 304 constitute graphical representations of the derived relationship between toner adhesion and transfer field strength in one exemplary marking device 102 (marking material transfer condition relationship), and similar relationships can be thus measured and derived for each of the devices 102 in the system 100 of FIGS. 1 and 2.

Referring also to FIGS. 1, 5, 6, and 9, the exemplary controller 122 is further operative to selectively change or adjust one or more of the toner state adjustment inputs 102*c*, 102*d*, 102*e*, 102*g*, 102*i*, 102*j*, 102*k*, 102*l*, and 102*m* based at least in part on the derived transfer condition relationship 302, 304. In the preferred implementations, the adjustment or adjustments are made so as to shift the curves 302, 304 to the left (lower detachment fields), as shown in the graph 500 of FIG. 6, to adjust the toner adhesion performance of the device 102 to yield adjusted CDF and PDF marking material transfer condition relationship 502, 504. The controller 122 may be configured to change one, some, or all the toner state adjustment inputs using any suitable adjustment algorithm, where the adjustment is verified to generate the resulting adjusted curves 502, 504, and the adjustment mode may include any number of iterations of this process. The controller 122, in this regard, causes the marking device 102 to again transfer toner 151-154 onto the medium 104 at the first value of the transfer field control input 102*b* following the change to the toner state adjustment input(s) 102*c*-102*k*, 102*d*, 102*e*, 102*g*, and 102*i*-102*m* while measuring the sensor signals, and from these the controller 122 derives the adjusted marking material transfer condition relationship 502, 504 as a function of the transfer field. The controller 122 then selectively changes the transfer field control input 102*b* based at least partially on the adjusted marking material transfer condition relationship (e.g., the controller 122 moves the transfer field control input from value 310 in FIG. 5 to value 510 in FIG. 6 based on the shifted curves), and thereafter the controller 122 selectively causes one or more of the marking devices 102 to transfer marking material onto the medium 104 in the normal printing mode in accordance with a print job 118 using the changed transfer field control input value 102*b*.

This adjustment process 10 is illustrated in an exemplary flow diagram in FIG. 1, wherein the process 10 may be performed for each of the marking devices 102 sequentially in one embodiment. At 12, the system is operated at initial values of the transfer field control inputs and initial values of the toner state adjustment actuator inputs in a normal operating (print job) mode. The toner adhesion state is measured for a first selected device 102 at 20 at one or more first transfer field control input values. A determination is made at 25 as to whether the adhesion state is sufficiently reduced or optimized, and if so (YES at 25), the process 10 proceeds to 60 for operation of the transfer field control actuators at a minimum acceptable transfer field levels during subsequent print jobs. If the toner adhesion state is not sufficiently reduced (NO at 25), the process 10 proceeds to adjust one or more toner state adjustment actuators at 30 to shift the toner adhesion state. In a preferred implementation, at least one of the actuated toner state adjustment actuators is upstream of the marking device 102 being adjusted. In the exemplary system 100, certain toner state adjustment actuators (e.g., 102*d*, 102*i*, 102*j*, 102*l*, and 102*m*) are fast and adjustment thereof has essentially immediate effect on the toner adhesion state, whereas others (e.g., 102*c*, 102*e*, and 102*k*) are slower, and the system 100 may be optionally returned to a normal print job mode when adjusting the slow actuators prior to proceeding to 40 in FIG. 1, although not a strict requirement of the present disclosure. In this regard, the xerographic actuators of the system include both transfer field control actuators (e.g., 102*a* with input 102*b*) and toner state adjustment actuators with adjustment inputs affecting the toner adhesion state (e.g., inputs 102*c*-102*e*, 102*g*, 102*i*-102*m*) as shown in FIG. 7 below.

The adjusted adhesion state is then measured at 40, for example, using one or more values of the transfer field control input (e.g., 102*b*), although a single field value can be used to ascertain the location of the curve. The system 100 can then be returned to normal operating mode at 60 if the toner state is sufficiently reduced at 25, or further iterations can be performed at 25, 20, and 40 in FIG. 1. In the illustrated example, a determination is made at 25 as to whether the adhesion state has been reduced to an acceptable level or otherwise optimized, and if not, the process returns to again adjust one or more of the actuators at 30 and again measure the toner adhesion state at 40. Once an acceptable adhesion state has been attained or a maximum number of iterations have been performed (YES at 25), the system 100 is returned to normal operation at 60 using a marking device transfer field level or value set according to the adjusted (current) toner adhesion state. The adjustment thus facilitates operation of the transfer field control actuators at reduced or minimum acceptable transfer field levels during subsequent print jobs while the toner state adjustment actuators may be thereafter operated at the initial values of 12, 20 above or at different levels.

Figure 6:
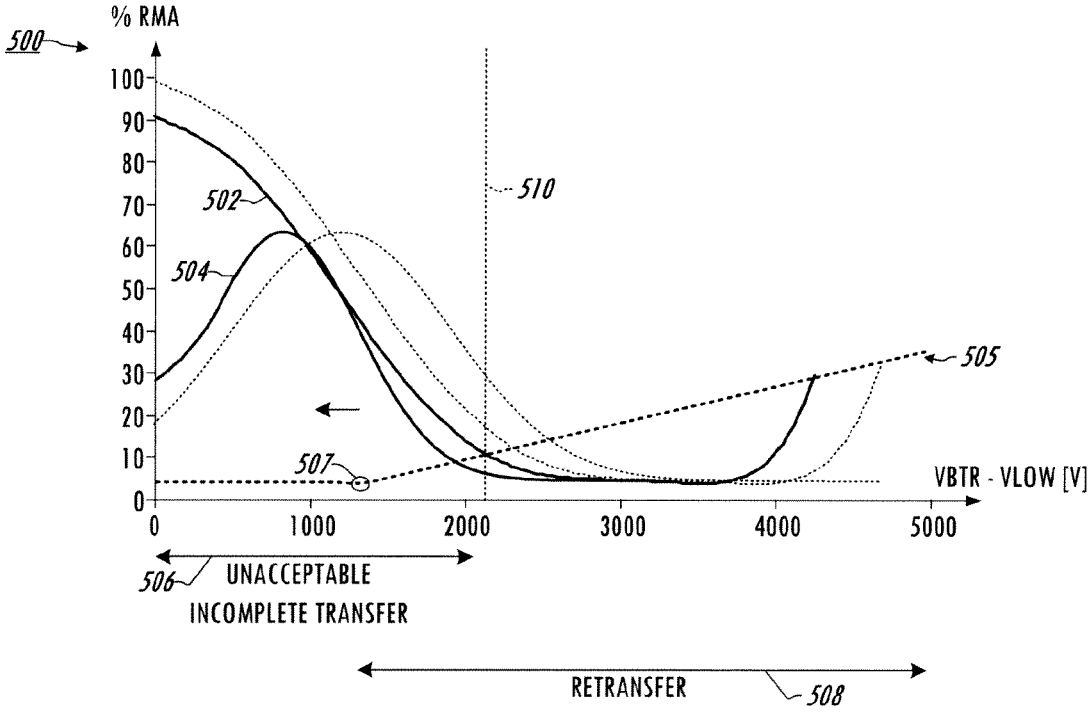
FIG. 6 is a graph illustrating shifting of the toner detachment PDF and CDF curves of FIG. 5 by selective adjustment of one or more marking engine actuators to modify the toner state in one of the marking devices in the system of FIGS. 1 and 2 according to various aspects of the present disclosure.

As shown in the shift of FIG. 6, the controller 122 in the illustrated example selectively changes one or more toner state adjustment inputs 102*c*, 102*d*, 102*e*, 102*g*, 102*i*-102*m* so as to reduce the mean and/or width of the PDF distribution curve 304 to obtain a shifted curve 504 that is narrower and/or centered at a lower field value. In preferred implementations, moreover, the controller 122 is operative in the adjustment mode to selectively lower the transfer field control input 102*b* for future printing to a value that provides acceptable toner transfer according to the adjusted curve(s) 502, 504. As one example, an acceptable transfer criteria established for a given marking device 102 may provide for operation at a field strength value (adjusted by the device control 102*b* in FIG. 4) that is at or close to the minimal value 510 in FIG. 6 which avoids significant incomplete transfer.

As shown in the graph 300 of FIG. 5, an operating setpoint 310 (e.g., a first value of the transfer field control input 102*b*) may be used prior to the adjustment aspects of the present disclosure to avoid an incomplete transfer region 306 of the relationships 302, 304, while either remaining as far as possible below the high field values associated with a retransfer region 308, or at least remaining at fields that minimize retransfer (305) toner loss to xerographic stations downstream of the station being adjusted, where 305 represents retransfer to the downstream photoreceptors, 307 represents the threshold for retransfer, and 308 represents the range of enhanced retransfer at high fields. Once the field exceeds the threshold 307, retransfer begins to increase to unacceptable levels, and ideally the system is operated below the threshold 307.

FIG. 6 illustrates a graph 500 showing shifting of the toner detachment distribution PDF and CDF curves of FIG. 5 by selective adjustment of one or more toner state adjustment actuator inputs 102*c*, 102*d*, 102*e*, 102*m*, 102*l*, 102J, 102K, 102*g*, 102*i*, 102*m* to modify the toner state in one of the marking devices 102 using the method 10 of FIG. 1, to yield the adjusted curves 502 and 504. An operating setpoint 510 can thereafter be used to avoid an incomplete transfer region 506 of the relationships 502, 504, while either remaining as far as possible below the high field values associated with a retransfer region 508, or at least remaining at fields that minimize retransfer (505) toner loss to xerographic stations downstream of the station being adjusted, where 505 represents retransfer to the downstream photoreceptors, 507 represents the threshold for retransfer, and 508 represents the range of enhanced retransfer at high fields. Once the field exceeds the threshold 507, retransfer begins to increase to unacceptable levels, and ideally the system is operated below the threshold 507.

As seen in FIGS. 5 and 6, the curves (and hence the toner adhesion state) have shifted to lower transfer field values, whereby the controller 112 can selectively lower the transfer field control input 102*b* to a value 510 (FIG. 6) that avoids an unacceptable incomplete transfer region 506 to provide acceptable toner transfer far away from the enhanced retransfer susceptibility region 508 according to the adjusted curve(s) 502, 504. If the value 510 of the transfer field cannot be reduced below the threshold 507 for retransfer, then retransfer can at least be reduced by operating at the minimal field value 510.

This process can be undertaken for optimizing or improving one, some, or all of the marking devices 102 in the system, with the net effect being to lower the operating transfer field levels in one or more devices 102. This, in turn, reduces the amount of retransfer occurring in adjusted devices 102 with respect to toner transferred to the ITB 104 at upstream devices 102, and also helps to address other high field defects in the printing system.

The controller 122, the sensor(s) 160, and the techniques of the present disclosure may thus be advantageously employed to facilitate minimization or reduction of retransfer in color tandem and multi-pass engines by sensing the toner adhesion state and employing closed loop adjustment to combat color shifts, inconsistent print quality, reduced color gamut, poor color macro-uniformity, toner waste, and other adverse performance issues related to retransfer or other high transfer field defects. In this regard, the various aspects of the present disclosure can be advantageously employed to reduce or eliminate hue shifts in color patches due to retransfer, low spatial frequency color variation in the cross process direction caused by non-uniform retransfer (also known as "retransfer smile"), high spatial frequency mottle and color shifts due to spatially non-uniform retransfer, toner waste and run cost associated with retransfer, cross contamination between xerographic marking stations by reducing the quantity of toner introduced into downstream stations from upstream stations through retransfer, as well as improving color consistency between each marking device 102, and may also facilitate cleaner-less xerographic station designs by mitigating contamination from upstream marking devices 102.

The controller 122, moreover, may be adapted to enter the adjustment mode and perform the above-described adjustment on demand, periodically, or at other times to minimize or lower the transfer field set-point required for toner transfer from a given device photoreceptor drum/belt 102*h* to the ITB 104 for combating the retransfer failure mode. The disclosure thus facilitates operation at or near the minimum acceptable transfer field set-point 410 so that the BTRs 102*a* or other transfer devices can be run at lower fields, thereby reducing or eliminating retransfer. This can be done, for example, under closed loop control by toner state sensing during cycle-up, cycle-down, or by periodically operating the machine in the adjustment mode, or in times of minimal system usage.

With respect to the measurement process at 20 and 40 in FIG. 1, the toner adhesion state in one implementation is ascertained by sensing the detachment field distribution (% RMA in FIGS. 5 and 6) as a function of applied transfer field or an appropriate surrogate like the current supplied by the BTR powers supply 102*b* to the BTR 102*a* or the voltage difference between the BTR shaft and the photoreceptor surface potential (in volts in FIGS. 5 and 6 representing the voltage difference between the BTR 102*a* and the photoreceptor surface potential determined by the surface charge density on the photoreceptor), where such measurements can be preferably done for all the xerographic marking stations 102 or a subset thereof, although not a strict requirement of the disclosure. The toner state at each station 102 can be measured during the formation of either single or multilayer test patches, for example, by measuring cyan RMA during formation of a cyan patch at the third device 102 in FIG. 2 (single layer), or during formation of a blue patch (two layer) with two devices 102 operating, or during formation of a process black patch (three layer), etc. The patches, moreover, could be solid areas or halftones.

The measurement/curve derivation aspects, moreover, may be of any suitable form to adequately characterize the toner adhesion state or other marking material transfer condition of the medium 104 to allow or facilitate identification of plausible adjustment ranges for shifting the toner state, and thereafter for changing the transfer field operating setpoint. In this respect, various features of a toner adhesion relationship (e.g., detachment field distribution) can be measured in accordance with the present disclosure. One such feature is the location (transfer field set-point) corresponding to the "low field wall" in the detachment field distribution, for example, a transfer field operating set-point corresponding to the median detachment field value in the PDF (e.g., measurements to discern the field value (e.g., x-axis voltage value in FIGS. 5 and 6 above) at which the % RMA=50%. Alternative points on the "low field wall" of the % RMA curve 304 could be measured and then shifted or minimized. For example it may be advantageous to measure the spot where RMA is equal to a target value, such as where 10%<TARGET %<50%. Another related measureable feature is the transfer field value on the "low field wall" corresponding to a maximum acceptable % RMA for a given toner color. The % MaxRMA target in this example could be selected to correspond to the lowest acceptable transfer efficiency (% TE=100−% RMA), which is equivalent to selecting TARGET %=% MaxRMA. Yet another feature which can be measured is the width of the distribution, which can be characterized as a standard deviation or multiple thereof, and which can be estimated by measuring several points on the "low field wall" of the % RMA curve and determining the slope. In addition, the maximum transfer efficiency may be measured as shifts in the % RMA in the flat, stable region of the curve 302 (roughly between 3000 and 4000V in curve 302) and this percentage can be minimized or reduced, which is essentially equivalent to maximizing or increasing the transfer efficiency.

Once one or more of the above or other suitable measurements have been obtained or derived from the sensor inputs, the controller 122 determines an estimate of the toner adhesion state for use in adjustment of one or more actuators in the marking devices 102 to change the operation of the transfer device, pre-transfer charging device, and toner dispensing components, etc. to improve the system performance by shifting the toner adhesion state (e.g., at 30 in FIG. 1). This adjustment may be done in any suitable manner by which the transfer field set-point value can be reduced in one or more of the devices 102 without significant adverse impact with respect to incomplete transfer. In particular, the desired adjustment can be characterized in terms of shifts in the detachment field distribution (toner adhesion state relationships), such as shifting the curves 302, 304 to the left in FIGS. 5 and 6 above. One suitable technique is to adjust one or more of the toner state adjustment actuator inputs 102*c*, 102*d*, 102*e* and, 102*g*, 102*i*-102*m* to minimize or reduce the slope of the % RMA curve 302 or by shifting the curve 302 to lower fields. Reducing the slope of curve 302 reduces the width of the detachment field distribution 304 and shifting the curve 302 reduces the mean of the detachment field in curve 304.

One or more suitable toner state adjustment actuators that can be used to shift the distribution include the toner charge state controls (e.g., the tribo or toner charge to mass ratio controls) for toner dispense rate (102*c*) and the pre-transfer charging device control (102*d*). In general, reducing the tribo of the toner (reducing the charge per unit mass) will shift the toner adhesion distribution curves 302, 304 (the detachment field distribution) to lower field values, thereby allowing the controller 122 to adjust the marking device transfer field setpoint value to a lower level. The tribo can thus be shifted by adjusting the toner dispense rate 102*c* in the development housing 102*g* (thereby affecting the toner concentration and thus the tribo state of the toner). While not wishing to be tied to any particular theory, toner adhesion state is believed to be generally related quadratically to toner charge, and as a result, the adhesion can be minimized at an optimal charge level, although absolute minimization is not required by the present disclosure. At low toner charge, the Lorentz force (F=qE) pulling the toner is small, and at high charge the adhesion due to the image force dominates. As a result, toner transfer may be optimized at intermediate charge levels. Depending on where the current charge state is relative to such an optimal level, the controller 122 may either increase or decrease the toner tribo via one or both of the controls 102*c*, 102*d*, with subsequent re-measurement of the toner state indicating whether the previous adjustment was in the right direction. In this regard, the controller 122 may also utilize information regarding the current toner concentration (TC, the mass ratio of toner to carrier) in addition to the measured adhesion state. If rapid tribo increases are desired (e.g., by decreasing the toner concentration TC) then ID zone patches could be developed to purge 102*k* toner 151. The toner charge state entering the nip 103 can also be modified by adjusting the current delivered by the pre-transfer device (control 102*d*).

Toner additives can also be modified by changing the toner state adjustment control input 102*e* to reduce or minimize adhesion. In this regard, without wishing to be tied to any particular theory, mechanical abuse in the development housing is believed to result in toner spacer additive impaction. Once the additives are driven below the surface of the toner, the adhesion increases and the detachment field distribution may broaden and shift to higher fields. The degree of additive impaction depends on the residence time of the toner 151 in the development housing. This can be a particularly serious problem if low area coverage documents are being printed, resulting in long toner residence times in the housing.

In another suitable control adjustment approach, the detachment field distribution may be shifted by a combination of dispensing fresh toner into the housing and purging 102*k* (FIGS. 7 and 8) old toner by developing ID zone patches or initiating some other form of intermittent purge cycle (e.g., with the controller 122 initiating a developer purge cycle based on developer age and actuator saturation information, in which the system 100 stops printing customer pages and prints only high area coverage purge images). Such a purge approach could also be coupled with a job scheduler such that the toner state could be managed through the adjustment of the image content being printed. Thus, if the toner state were drifting in a "bad" direction, then the job scheduler implemented by or in conjunction with the controller 122 could switch to printing a document with a higher area coverage to help to purge some of the old material from the developer housings.

The additive state could also be improved by dispensing fresh additives via the toner state adjustment control 102*e* into the housing and blending them onto the toner 151. This would require adding an additive dispensing device to the development housing. Alternatively a device could be added that would dispense spacer particles directly to the photoreceptor prior to development 102*l*. The various concepts of the disclosure can be used in conjunction with adjustment of any actuator within the marking engine 102 that shifts the detachment field distribution (toner adhesion state) to lower fields or reduces the width of the distribution.

Once the adjustment has been made (or a number of measurement/adjustment iterations have been performed), the field control inputs (e.g., 102*b*) of the marking devices 102 are operated by the controller 122 at the minimal acceptable transfer field. While not wishing to be tied to any particular theory, high transfer field levels are believed to contribute to retransfer in a two step process. First wrong sign toner is generated within each transfer nip 103, and then in the downstream nips, the same high fields that generated the wrong sign toner back-transfer the toner 151 from the medium 104 to the photoreceptor drums 102*h* of the downstream devices 102. If the field exceeds a certain threshold value, then wrong sign toner is generated in each of the transfer nips due to air breakdown within the toner pile. The high fields generate wrong sign toner and also result in large electrostatic forces pulling the toner from the medium 104 back to the photoreceptors 102*h*. It is therefore believed that minimizing or reducing the transfer field in some or all the nips, wrong sign toner generation and the amount of wrong sign toner retransferred to downstream photoreceptors 102*h* can be reduced.

The controller 122 thus operates to adjust the toner charge state in an effort to minimize the adhesion state of the toner, thereby facilitating lower transfer field operation. This reduction in the transfer field will then have a positive impact on retransfer since the charge state of the toner pile traveling through a transfer nip 103 will be affected much less than it would at higher transfer fields.

It is also noted that while the concepts and aspects of the disclosure have been presented above in the context of a tandem color architecture, these concepts are also applicable to a multi-pass color architecture, in which two or more development housings are utilized on each photoreceptor. The image is assembled on the medium 104 in multiple passes, and the ITB cleaner and second transfer device engage the medium 104 after the image has been fully assembled and is ready for transfer to the substrate.

Figure 8:
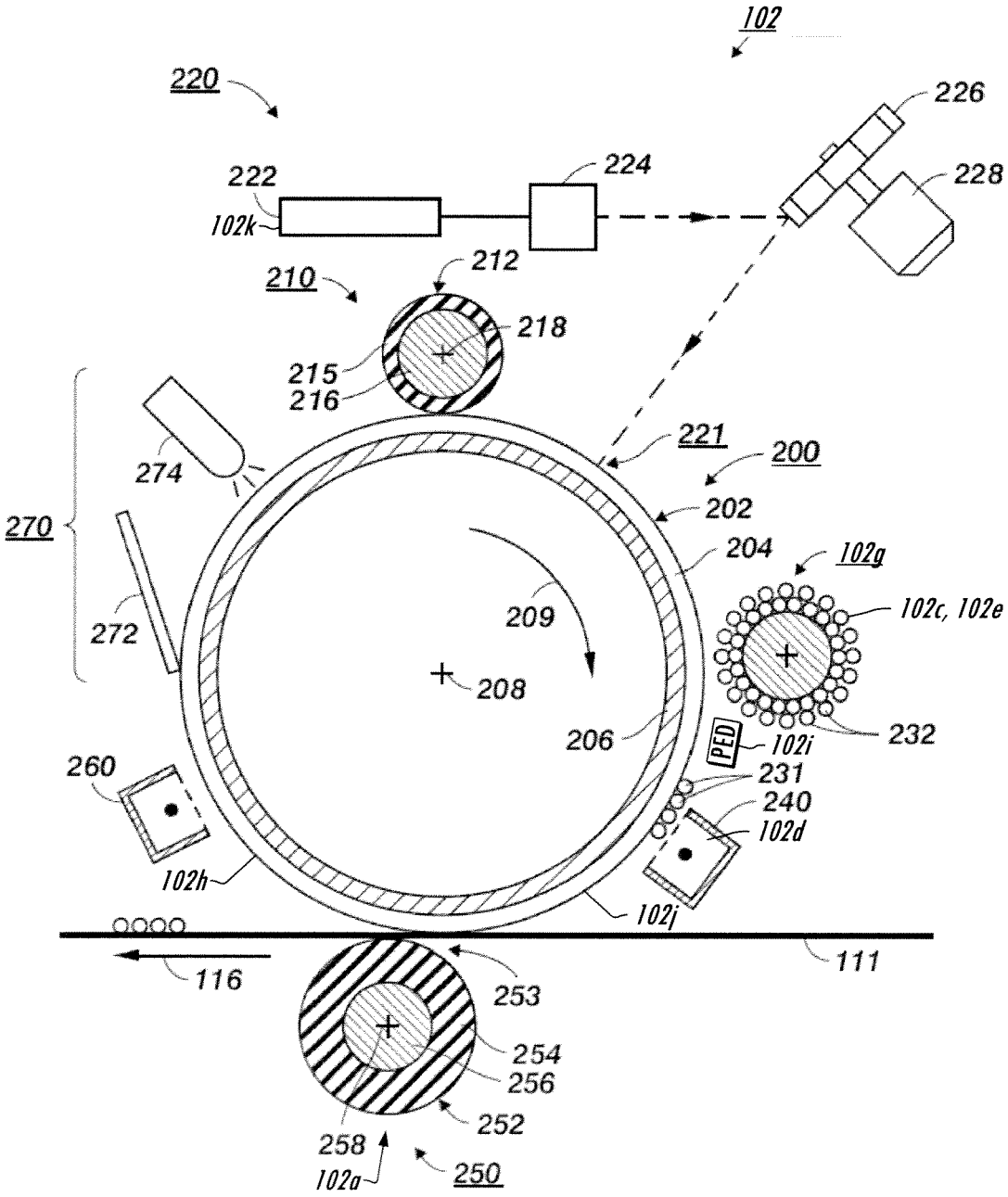
FIG. 8 is a schematic diagram illustrating an exemplary imaging apparatus of a xerographic apparatus.

FIG. 8 illustrates another exemplary marking device 102 which can be one of multiple marking devices in a document processing system 100. The device 102 of FIG. 8 includes a photoreceptor 200 (also referred to as OPC), a charging station or subsystem 210, a laser scanning device or subsystem 220, such as a rasterizing output scanner (ROS), a toner deposition/development station or subsystem 102*g*, a pre-transfer station or subsystem 240, a transfer station or subsystem 250, a precleaning station or subsystem 260, and a cleaning/erase station 270. The photoreceptor 200 in this embodiment is a drum, but other forms of photoreceptor could conceivably be used.

The photoreceptor drum 200 includes a surface 202 of a photoconductive layer 204 on which an electrostatic charge can be formed, and which layer 204 behaves like a dielectric in the dark and a conductor when exposed to light. The photoconductive layer 204 is mounted or formed on a cylinder 206 that is mounted for rotation on a shaft 208 in the direction of the arrow 209. The charging station 210 includes a biased charging roller 212 that charges the photoreceptor 200 using a DC-biased AC voltage. The biased charging roller 212 includes a surface of one or more elastomeric layers 215 formed or mounted on an inner cylinder 216, such as a steel cylinder or other suitable material, mounted for rotation about an axis of a shaft 218.

The laser scanning device 220 includes a controller 222 that modulates the output of a laser 224, such as a diode laser, whose modulated beam shines onto a rotating mirror or prism 226 rotated by a motor 228. The mirror or prism 226 reflects the modulated laser beam onto the charged OPC surface 202, panning it across the width of the OPC surface 202 so that the modulated beam can form a line 221 of the image to be printed on the OPC surface 202. In this way a latent image is created by selectively discharging the areas which are to receive the toner image. Exposed (drawn) portions of the image to be printed move on to the toner deposition station 102*g*, where toner 232 adheres to the drawn/discharged portions of the image.

The exposed portions of the image with adherent toner then pass to the pretransfer station 240 and on to the transfer station 250. The pre-transfer station 240 is used to adjust the charge state of the toner and photoreceptor in order to optimize transfer performance. The transfer station 250 includes a biased transfer roller 252 arranged to form a nip 253 on an intermediate transfer belt medium 104 with the OPC 200 for transfer of the toner image 231 onto the medium 104 traveling in the direction 116. The biased transfer roller 252 includes one or more elastomeric layers 254 formed or mounted on an inner cylinder 256, and the roller 252 is mounted on a shaft 258 extending along a longitudinal axis of the roller 252. The biased transfer roller 252 carries a DC potential provided by a high voltage power supply, and the voltage applied to the roller 252 draws the toner image 231 from the photoreceptor surface 202 to the medium 104. After transfer, the OPC surface 202 rotates to the precleaning subsystem 260 and thereafter to the cleaning/erasing substation 270, where a blade 272 scrapes excess toner from the OPC surface 202 and an erase lamp 274 reduces the static charge on the OPC surface.

Figure 9:
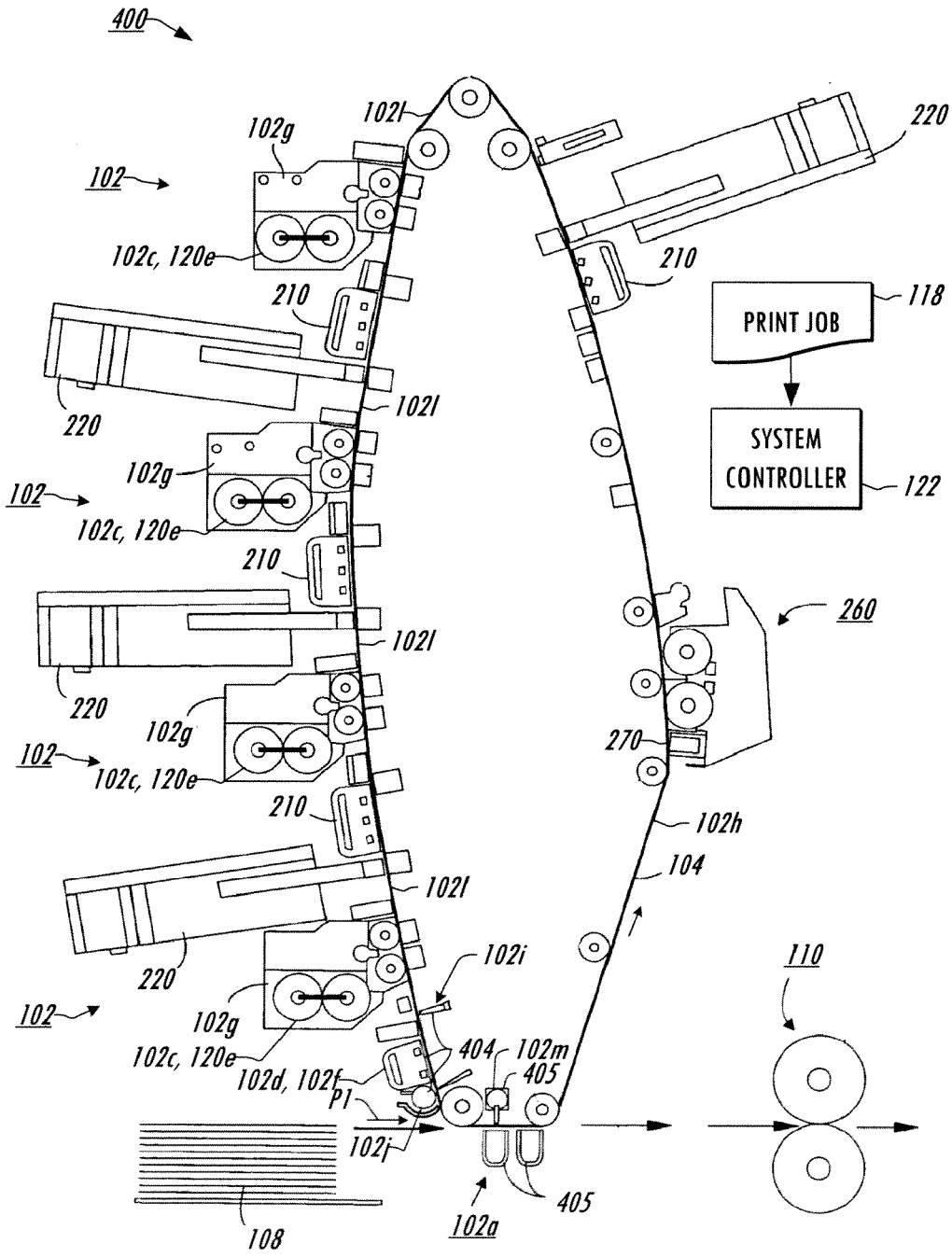
FIG. 9 is a system level diagram illustrating yet another exemplary multi-color document processing system with multiple xerographic marking devices and corresponding photoreceptor belt.
Figure 10:
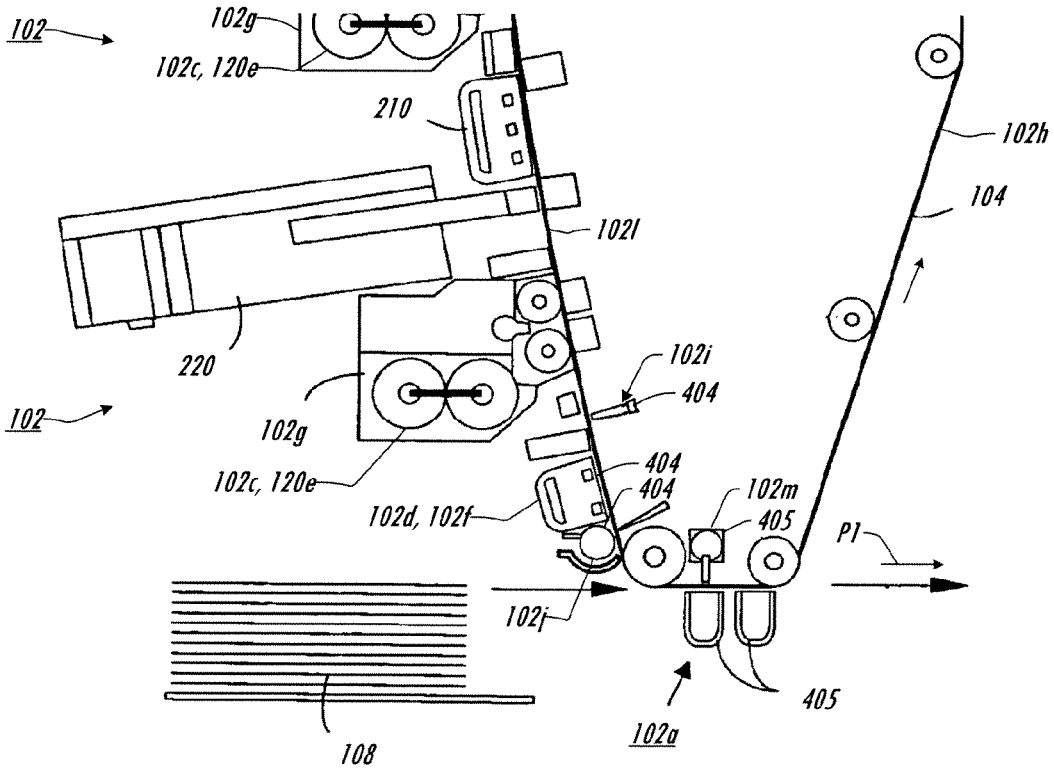
FIG. 10 is a partial system diagram illustrating an exemplary portion of the document processing system of FIG. 9.

FIGS. 9 and 10 show an exemplary multi-color document processing system 400 with multiple xerographic marking devices 102 and corresponding photoreceptor belt 102*h* that also operates as an ITB 104, in which the paper path P1 flows from left to right, and the ITB 104 travels in a counterclockwise direction. As best shown in FIG. 10, each device 102 includes a pre-transfer expose (PTE) 102*i*, also called pre-transfer erase. The system 400 further includes a pre-transfer charge 102*d*, and a debris removal device 102*j* (e.g., hybrid air knife as best seen in FIG. 10) for debris removal. The pre-transfer erase 102*i* may be on the back of the photoreceptor in certain embodiments where the belt 104 is semi-transparent. In tandem ITB architectures, the pre-transfer erase 102*i* is preferably on the front surface of the photoreceptor drum (which is not transparent). 102*a* is a dicorotron, not a BTR, which generates a transfer field by depositing charge on the back of the medium 104. As in the case of a BTR, the field can be varied by adjusting the control biases on the dicorotron 102*a*. The photoreceptor belt is vibrated at ultrasonic frequencies to mechanically loosen the toner as the transfer field is applied by the dicorotron 102*a*.

The system 400 further includes an acoustic transfer assist actuator 102*m*. The acoustic transfer assist actuator 102*m* is operative to selectively vibrate the photoreceptor belt 104 at ultrasonic frequencies to mechanically loosen the toner as the transfer field is applied by the dicorotron 102*a*.

FIGS. 9 and 10 depict an exemplary image-on-image (IOI) type printing system 400 in which images are initially built on a photoreceptor belt 104 via a series of marking devices 102 including tandem configured charge and recharge components 210, exposing components 220, and developers 102*g*. The system 400 also provides pre-transfer and transfer components 404 (pre-transfer erase, etc.) and 405, respectively, to transfer the built image from the belt 104 to the final print media 108 as well as a system controller 122 that receives a print job 118. The system 400 includes a fuser type affixing apparatus 110 as well as cleaning and erasing components 260 and 270, respectively.

The above examples are merely illustrative of several possible embodiments of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several embodiments, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising". It will be appreciated that various of the above-disclosed and other features and functions, or alternatives thereof, may be desirably combined into many other different systems or applications, and further that various presently unforeseen or unanticipated alternatives, modifications, variations or improvements therein may be subsequently made by those skilled in the art which are also intended to be encompassed by the following claims.

The invention claimed is:

1. A document processing system, comprising:

a plurality of marking devices operative to transfer marking material onto a corresponding medium, the individual marking devices comprising at least one transfer field control actuator controlling a transfer field used to transfer marking material by the marking device onto the medium with a transfer field control input for setting the transfer field used by the transfer field control actuator;

at least one toner state adjustment actuator having a toner state adjustment input for adjusting an operating parameter associated with transfer of marking material by the marking device onto the medium;

at least one sensor operative to sense a marking material transfer condition associated with the medium; and a controller operatively coupled with the marking devices and operative in a normal mode to selectively cause one or more of the marking devices to transfer marking material onto the medium in accordance with a print job, the controller being operative in an adjustment mode for individual ones of the plurality of marking devices:

to cause the marking device to transfer marking material onto the medium at one or more values of the transfer field control input input value and at least one initial value of the toner state adjustment input, to obtain marking material transfer condition values from the sensor corresponding to the one or more transfer field control input values and the initial toner state adjustment input value, to derive a marking material transfer condition relationship as a function of the transfer field based on the marking material transfer condition values from the sensor, to selectively change the toner state adjustment input to a changed toner state adjustment input value based at least partially on the derived transfer condition relationship, to cause the marking device to again transfer marking material onto the medium at one or more values of the transfer field control input using the changed toner state adjustment input value, to obtain adjusted marking material transfer condition values from the sensor, to derive an adjusted marking material transfer condition relationship as a function of the transfer field based on the adjusted marking material transfer condition values from the sensor, and to selectively reduce the transfer field control input to a reduced transfer field control input value that provides acceptable transfer of marking material based at least partially on the adjusted marking material transfer condition relationship, and the controller is thereafter operative in the normal mode to selectively cause one or more of the marking devices to transfer marking material onto the medium in accordance with a print job using the changed transfer field control input value.

2. The document processing system of claim 1, wherein the controller is operative in the adjustment mode to selectively lower the transfer field control input to a value that avoids unacceptable incomplete transfer of marking material while reducing retransfer of marking material previously provided to the medium according to the adjusted marking material transfer condition relationship.

3. The document processing system of claim 1, wherein the marking devices are xerographic marking devices.

4. The document processing system of claim 1, wherein the plurality of marking devices includes at least four marking devices individually associated with a different color separation C, M, Y, K.

5. The document processing system of claim 1, wherein the sensor is operative to sense residual mass per unit area RMA of marking material not transferred to the medium.

6. The document processing system of claim 1, wherein the marking material transfer condition relationship is a toner detachment field distribution curve as a function of the transfer field based on the values from the sensor, the distribution curve having a mean and a width, and wherein the controller is operative to selectively change the at least one toner state adjustment input to reduce at least one of the mean or width of the distribution curve.

7. The document processing system of claim 1, wherein the at least one toner state adjustment input is a toner dispense rate control input to adjust a charge to mass ratio of a mixture of toner and carrier in the marking device.

8. The document processing system of claim 1, wherein the at least one toner state adjustment input is a pre-transfer charging device adjustment control input to adjust a toner charge state in the marking device.

9. The document processing system of claim 1, wherein the at least one toner state adjustment input is a toner additive state adjustment control input to adjust a toner additive state in the marking device.

10. The document processing system of claim 1, wherein the at least one toner state adjustment input is a toner purge control input to adjust a toner age or concentration of the marking device.

11. The document processing system of claim 1, wherein the at least one toner state adjustment actuator includes an intermediate transfer actuator with an adjustment input for adjusting an operating parameter associated with transfer of marking material from an intermediate medium to a printable medium.

12. The document processing system of claim 11, wherein the at least one intermediate transfer actuator is an acoustic transfer assist actuator.

13. The document processing system of claim 1, comprising a plurality of toner state adjustment actuators with corresponding toner state adjustment inputs for individually adjusting an operating parameter associated with transfer of marking material onto the medium, wherein the marking devices individually include at least one of the toner state adjustment actuators, and wherein one or more of the toner state adjustment actuators is not associated with a specific one of the marking devices.

14. The document processing system of claim 1, wherein the at least one toner state adjustment actuator is upstream of a transfer nip associated with the transfer field control actuator whose transfer field input is being reduced.

15. The document processing system of claim 1, wherein the at least one toner state adjustment actuator is not associated with a specific one of the plurality of marking devices.

16. A method of operating a document processing system having a plurality of marking devices to transfer marking material onto a medium, the method comprising:

operating the marking devices in a normal mode to selectively transfer marking material onto the medium in accordance with a print job;

in an adjustment mode, operating individual ones of the plurality of marking devices to transfer marking material onto the medium at one or more values of a transfer field control input and at least one initial value of a toner state adjustment input controlling an operating parameter of a toner state adjustment actuator;

in the adjustment mode for the operated individual marking devices, obtaining marking material transfer condition values corresponding to the transfer field control input value and the initial toner state adjustment input value;

in the adjustment mode for the operated individual marking devices, deriving a marking material transfer condition relationship as a function of the transfer field based on the marking material transfer condition values;

in the adjustment mode for the operated individual marking devices, selectively changing the toner state adjustment input to a changed toner state adjustment input value based at least partially on the derived transfer condition relationship;

in the adjustment mode for the operated individual marking devices, again transferring marking material onto the medium at one or more values of the transfer field control input using the changed toner state adjustment input value;

in the adjustment mode for the operated individual marking devices, obtaining adjusted marking material transfer condition values;

in the adjustment mode for the operated individual marking devices, deriving an adjusted marking material transfer condition relationship as a function of the transfer field based on the adjusted marking material transfer condition values; and selectively reducing the transfer field control input to a reduced transfer field control input value that avoids unacceptable incomplete marking material transfer based at least partially on the adjusted marking material transfer condition relationship; and thereafter operating one or more of the marking devices in the normal mode to transfer marking material onto the medium in accordance with a print job using the reduced transfer field control input value.

17. The method of claim 16, including keeping transfer field generating components of all the marking devices powered while operating individual ones of the plurality of marking devices in the adjustment mode.

18. The method of claim 16, wherein the marking material transfer condition relationship is a toner detachment distribution curve as a function of the transfer field, the distribution curve having a mean and a width, and wherein the at least one toner state adjustment input is selectively changed to reduce at least one of the mean or width of the distribution curve.

19. The method of claim 16, wherein selectively changing the at least one toner state adjustment input comprises changing a toner dispense rate control input to adjust a charge to mass ratio of a mixture of toner and carrier in the marking device.

20. The method of claim 16, wherein selectively changing the at least one toner state adjustment input comprises chang ing a pre-transfer charging device adjustment control input to adjust toner charge state in the marking device.

21. The method of claim 16, wherein selectively changing the at least one toner state adjustment input comprises changing a toner additive state adjustment control input to adjust a toner additive state in the marking device.

22. The method of claim 16, wherein selectively changing the at least one toner state adjustment input comprises changing a toner purge control input to adjust toner age or concentration of the marking device.

23. The method of claim 16, wherein the at least one toner state adjustment actuator is upstream of a transfer nip associated with the transfer field control actuator whose transfer field input is being reduced.

24. The method of claim 16, wherein the at least one toner state adjustment actuator is not associated with a specific one of the plurality of marking devices.

* * * * *